US008567879B2

(12) United States Patent
Carter et al.

(10) Patent No.: US 8,567,879 B2
(45) Date of Patent: Oct. 29, 2013

(54) GARAGE STORAGE SYSTEMS

(75) Inventors: Gary Keith Carter, Maricopa, AZ (US); William Basore, Fountain Hills, AZ (US)

(73) Assignee: Bill Basore, Fountain Hills, AZ (US)

( * ) Notice: Subject to any disclaimer, the term of this patent is extended or adjusted under 35 U.S.C. 154(b) by 0 days.

(21) Appl. No.: 13/017,847

(22) Filed: Jan. 31, 2011

(65) Prior Publication Data

US 2011/0187247 A1 Aug. 4, 2011

Related U.S. Application Data

(60) Provisional application No. 61/300,009, filed on Jan. 31, 2010.

(51) Int. Cl.

| | |
|---|---|
| ***A47B 87/00*** | (2006.01) |
| ***A47B 47/00*** | (2006.01) |
| ***A47B 91/00*** | (2006.01) |
| ***F16D 1/08*** | (2006.01) |
| ***F16M 11/26*** | (2006.01) |

(52) U.S. Cl.
USPC ..... 312/108; 312/111; 312/263; 312/351.3; 403/362; 248/188.5

(58) Field of Classification Search
USPC ..... 312/107, 245, 257.1, 351.1, 351.3, 108, 312/111, 109; 248/188.8, 188.5, 677; 403/362
See application file for complete search history.

(56) References Cited

U.S. PATENT DOCUMENTS

| | | | | |
|---|---|---|---|---|
| 3,791,709 | A * | 2/1974 | Cross | 312/245 |
| 4,108,514 | A * | 8/1978 | Zimmerman | 312/107 |
| 4,265,501 | A * | 5/1981 | Halliburton | 312/108 |
| 4,576,355 | A * | 3/1986 | Graf | 248/544 |
| 4,586,759 | A * | 5/1986 | Wrobel | 312/198 |
| 4,893,884 | A * | 1/1990 | Tsuchida et al. | 312/107 |
| 5,244,271 | A * | 9/1993 | Hackwood et al. | 312/313 |
| 5,392,934 | A * | 2/1995 | Fox | 211/94.01 |
| 5,791,612 | A * | 8/1998 | King | 248/188.4 |
| 5,881,980 | A * | 3/1999 | Knudson | 248/188.8 |
| 5,975,660 | A * | 11/1999 | Tisbo et al. | 312/263 |
| 6,155,662 | A * | 12/2000 | Fookes et al. | 312/351.1 |
| 6,354,231 | B1 * | 3/2002 | Morris | 108/144.11 |
| 6,478,391 | B1 | 11/2002 | Stoever | |
| 6,711,985 | B1 * | 3/2004 | Doyle | 92/117 A |
| 6,722,750 | B2 * | 4/2004 | Chan | 312/258 |

(Continued)

*Primary Examiner* — David Dunn
*Assistant Examiner* — Ryan A. Doyle
(74) *Attorney, Agent, or Firm* — Keith L. Jenkins, Registered Patent Attorney, LLC; Keith L. Jenkins

(57) ABSTRACT

Cabinets adapted for non-level garage floors and out-of-plumb garage walls with leveling controls operated from inside each cabinet. The cabinets have in common that they are attachable to a garage wall and each has at least one adjustment panel forming a part of the back of the cabinet. Each adjustment panel has a hand screw for extending behind the cabinet to engage the wall to provide back-to-front leveling and to prevent installation of fasteners, such as screws, from pulling the cabinet closer to the wall during installation. Each adjustment panel also has horizontal slots in a staggered arrangement in two horizontal rows for receiving fasteners. Floor-standing cabinets have feet that are adjustable from inside the cabinet. Wall-hanging cabinets have a top bracket that provides side-to-side leveling form inside. Floor-standing cabinets are modular and stackable, using an included adapter and door-handle coupler to enable stacked cabinet doors to open as one.

16 Claims, 11 Drawing Sheets

(56) References Cited

U.S. PATENT DOCUMENTS

| | | | | |
|---|---|---|---|---|
| 7,159,829 | B1 * | 1/2007 | Finkelstein | 248/188.4 |
| 8,087,735 | B1 * | 1/2012 | Rheault et al. | 312/109 |
| 2004/0222721 | A1 * | 11/2004 | Kelley et al. | 312/205 |
| 2006/0192466 | A1 * | 8/2006 | Flyer et al. | 312/100 |
| 2007/0052330 | A1 * | 3/2007 | Chang | 312/111 |
| 2008/0028803 | A1 * | 2/2008 | Lee et al. | 68/23.1 |
| 2008/0272676 | A1 * | 11/2008 | Eustace et al. | 312/243 |
| 2009/0134307 | A1 * | 5/2009 | Hamann | 248/694 |
| 2009/0184614 | A1 * | 7/2009 | Walsberg | 312/351.3 |
| 2009/0267463 | A1 * | 10/2009 | Nilsson | 312/138.1 |
| 2011/0115351 | A1 * | 5/2011 | McManic et al. | 312/270.1 |

* cited by examiner

GARAGE STORAGE SYSTEMS

RELATED APPLICATIONS

This application claims the benefit of U.S. Provisional Patent Application Ser. No. 61/300,009 filed Jan. 31, 2010 for the same inventor.

FIELD OF THE INVENTION

This invention relates to a garage or workshop storage system that can provide level cabinets on sloping garage or workshop floors and against non-plumb walls. The invention further relates to a garage or workshop storage system that is modular for stacking of cabinets.

BACKGROUND

Floors in garages have a slope to assist in drainage, and often the walls are not plumb (vertical). Accordingly, the problem arises as to how to install cabinets for storing tools, equipment, parts, and the like in a way that keeps the shelves in the cabinet level.

Therefore, a need exists for a garage storage system that can be leveled to suit the particular floor slope. A need also exists for a garage storage system that can be abutted to a non-plumb wall and made plumb by internal adjustments. A need exists for a garage storage system that is easy to install. A need exists for a garage storage system that can be manufactured in various modular sizes and can be coupled together. A need exists for a garage storage system design that can be adapted to retaining various types of garage configurations.

OBJECTS AND FEATURES OF THE INVENTION

A primary object and feature of the present invention is to overcome the above-mentioned problems and fulfill the above-mentioned needs.

Another object and feature of the present invention is to provide a garage storage system that can be abutted to a non-plumb wall and made plumb by internal adjustments. Another object and feature of the present invention is to provide a garage storage system that is easy to install. Another object and feature of the present invention is to provide a garage storage system that can be manufactured in various modular sizes and can be coupled together. Another object and feature of the present invention is to provide a garage storage system design that can be adapted to various types of garage configurations.

It is an additional primary object and feature of the present invention to provide garage storage system that is safe, inexpensive, easy to clean, and handy. Other objects and features of this invention will become apparent with reference to the following descriptions.

SUMMARY OF THE INVENTION

In accordance with a preferred embodiment hereof, the present invention provides a garage storage system with legs that have individual height adjustments that can be accessed from inside the cabinet. The present invention also provides adjustable standoffs to adjust the angle which the cabinet makes with the wall. The present invention also provides a bracket for attaching to a garage wall and inserting into the back of a wall-hanging cabinet, which provides side-to-side leveling adjustment features as well as adjustable standoffs to adjust back-to-front leveling. The present invention also provides and adapter for connecting two cabinets vertically.

The invention includes cabinets adapted for non-level garage floors and out-of-plumb garage walls with leveling controls operated from inside each cabinet. The cabinets have in common that they are attachable to a garage wall and each has at least one adjustment panel forming a part of the back of the cabinet. Each adjustment panel has a hand screw for extending behind the cabinet to engage the wall to provide back-to-front leveling and to prevent installation of fasteners, such as screws, from pulling the cabinet closer to the wall during installation. Each adjustment panel also has horizontal slots in a staggered arrangement in two horizontal rows for receiving fasteners. Floor-standing cabinets have feet that are adjustable from inside the cabinet. Wall-hanging cabinets have a top bracket that provides side-to-side leveling form inside. Floor-standing cabinets are modular and stackable, using an included adapter and door-handle coupler to enable stacked cabinet doors to open as one.

A cabinet securable to a wall, the cabinet including: a adjustment panel that includes: a hand screw installed through the adjustment panel; and at least three horizontal slots, arranged in two horizontal rows, sized for receiving fasteners having heads; where the adjustment panel forms a portion of a back of the cabinet. The cabinet, where the adjustment panel includes: a threaded hand screw sleeve: and a threaded hand screw, operable to extend beyond a plane defined by the surface of the adjustment panel, responsive to being manually turned in the hand screw sleeve. The cabinet, where the hand screw further includes; a cylindrical web having external threads and closed on a first end; a longitudinal axle extending from the first end; a manual flange supported by the axle and by the cylindrical web having external threads; and a plurality of bracing flanges extending from the axle to the cylindrical web. The cabinet, including at least two adjustable feet, each manually adjustable through an opening in a bottom panel of the cabinet using a torque-delivering tool. The cabinet, where each the adjustable foot of the at least two adjustable feet includes: a shell including: a base configured to receive a frictional bottom cap; a first cylindrical foot web extending upward from the base; and a captive nut near a top of the shell; a sleeve including: a second cylindrical foot web sized to slidingly receive the first cylindrical web; a captive washer near a top of the second cylindrical foot web sized and positioned to capture a particular bolt head; a bolt, having the particular bolt head having a torque-receiving socket, extending through the captive washer and threaded into the captive nut; a fastener plate, including a plurality of fastener openings and a central opening alignable to the torque-receiving socket, where the fastener plate is attached to a top edge of the second cylindrical web. The cabinet, including a bracket, the bracket further including: a back panel having a staggered arrangement of at least seven horizontal slots in two horizontal rows; first and second opposed end panels extending at right angles to the back panel, where the first and second opposed end panels have first and second threaded rods, respectively, extending from first and second inside surfaces of the first and second end panels, respectively; first and second corner reinforcements between the back panel and the first and second end panels, where the first and second corner reinforcements include first and second threaded bores, respectively; first and second adjustment screws operable to be threaded into and through the threaded bores; and first and second end fastener plates slidingly receivable into the first and second end panels, respectively, where: the first and second end fastener plates include first and second horizontal slots sized to receive the first and second threaded rods, respectively; the first and second end fastener plates include first and second vertical slots; and a flange extending downward from the back panel; and extending horizontally outward from the back panel by a length equal to a thickness of a sidewall of the cabinet. The cabinet, including a removable top panel. The cabinet, including: the cabinet with the removable top panel removed; an upper modular cabinet including a top panel; an adapter for coupling the upper modular cabinet to the cabinet, where the adapter is operable to be installed in place of the removable top panel. The cabinet, where the adapter includes: a center piece; left and right wings coupled orthogonally to the center piece and parallel to each other to form the adapter with top and bottom surfaces, a plurality of lock pins extending from the top and bottom surfaces; and a plurality of dowels extending from the top and bottom surfaces. The cabinet, further including: first bi-fold doors on the cabinet; second bi-fold doors on the upper modular cabinet; first left and right handles near a top of the first bi-fold doors and near a closure seam of the first bi-fold doors; second left and right handles near a bottom of the second bi-fold doors and near a closure seam of the second bi-fold doors; left and right door-handle couplings engaging first and second left door handles and first and second right door handles, respectively; and where the left and right door-handle couplings are sufficiently rigid to enable first and second left doors to be operated as one door and to enable first and second right doors to be operated as one door, respectively.

A cabinet securable to a wall, the cabinet including: an adjustment panel, including: a hand screw installed through the adjustment panel; and at least three horizontal slots, arranged in two horizontal rows, sized for receiving fasteners having heads; where the adjustment panel forms a portion of a back of the cabinet; a bottom panel having a plurality of openings corresponding to a plurality of adjustable feet attached there under, where the plurality of openings provide access to adjusting means for the adjustable feet; and a removable top panel. The cabinet, where each adjustable foot of the plurality of adjustable feet includes: a shell including: a base configured to receive a frictional bottom cap; a first cylindrical web extending upward from the base; and a captive nut near a top of the shell; a sleeve including: a second cylindrical web sized to slidingly receive the first cylindrical web; a captive washer near a top of the second cylindrical web sized and positioned to capture a particular bolt head; a bolt, having the particular bolt head having a torque-receiving socket, the bolt extending through the captive washer and threaded into the captive nut; a fastener plate, including a plurality of fastener openings and a central opening alignable to the torque-receiving socket, where the fastener plate is attached to a top edge of the second cylindrical web. The cabinet, including: the cabinet with the removable top panel removed; an upper modular cabinet including a top panel; an adapter for coupling the upper modular cabinet to the cabinet, where the adapter is operable to be installed in place of the removable top panel. The cabinet, where the adapter includes: a center piece; left and right wings coupled orthogonally to the center piece and parallel to each other to form the adapter with top and bottom surfaces, a plurality of lock pins extending from the top and bottom surfaces; and a plurality of dowels extending from the top and bottom surfaces. The cabinet, further including: first bi-fold doors on the cabinet; second bi-fold doors on the upper modular cabinet; first left and right handles near a top of the first bi-fold doors and near a closure seam of the first bi-fold doors; second left and right handles near a bottom of the second bi-fold doors and near a closure seam of the second bi-fold doors; and left and right door-handle couplings engaging first and second left door handles and first and second right door handles, respectively; and where the left and right door-handle sleeves are sufficiently rigid to enable first and second left doors to be operated as one door and to enable first and second right doors to be operated as one door, respectively.

A cabinet securable to a wall, the cabinet including: first and second adjustment panels, each including: a hand screw installed through the adjustment panel; and at least three horizontal slots, arranged in two horizontal rows, sized for receiving fasteners having heads; a bottom panel including a front and a back; first and second opposing side panels, each having a top and a bottom, coupled to the bottom panel; where the first adjustment panel is coupled between the first and second opposing side panels near the back of the bottom panel. The cabinet, where the second adjustment panel is coupled between the first and second opposing side panels flush with the tops of the side panels; an upper modular cabinet including a top panel; third and fourth adjustment panels, each including: a hand screw installed through the adjustment panel; and at least three horizontal slots, arranged in two horizontal rows, sized for receiving fasteners having heads; an adapter for coupling the upper modular cabinet to the cabinet, where the adapter is operable to be installed on top edges of the first and second opposing side panels and on a top edge of the second adjustment panel, where the adapter includes: a center piece; left and right wings coupled orthogonally to the center piece and parallel to each other to form the adapter with top and bottom surfaces, a plurality of lock pins extending from the top and bottom surfaces; and a plurality of dowels extending from the top and bottom surfaces; first bi-fold doors on the cabinet; second bi-fold doors on the upper modular cabinet; first left and right handles near a top of the first bi-fold doors and near a closure seam of the first bi-fold doors; second left and right handles near a bottom of the second bi-fold doors and near a closure seam of the second bi-fold doors; left and right door-handle couplings engaging first and second left door handles and first and second right door handles, respectively; and where the left and right door-handle couplings are sufficiently rigid to enable first and second left doors to be operated as one door and to enable first and second right doors to be operated as one door, respectively; a plurality of openings in the bottom panel corresponding to a plurality of adjustable feet attached there under, where the plurality of openings provide access to adjusting means for the plurality of adjustable feet; where each adjustable foot of the plurality of adjustable feet includes: a shell including: a base configured to receive a frictional bottom cap; a first cylindrical web extending upward from the base; and a captive nut near a top of the shell; a sleeve including: a second cylindrical web sized to slidingly receive the first cylindrical web; a captive washer near a top of the second cylindrical web sized and positioned to capture a particular bolt head; a bolt, having the particular bolt head having a torque-receiving socket, extending through the captive washer and threaded into the captive nut; a fastener plate, including a plurality of fastener openings and a central opening alignable to the torque-receiving socket, where the fastener plate is attached to a top edge of the second cylindrical web. The cabinet, further including: a bracket, coupled between the first and second side panels flush with top edges of the first and second side panels, the bracket further including: a back panel having a staggered arrangement of horizontal slots in two horizontal rows; first and second opposed end panels extending at right angles to the back panel, where the first and second opposed end panels have first and second threaded rods, respectively, extending from first and second inside surfaces of the first and second end panels, respectively; first and second corner reinforcements between the back panel and the first and second end panels, where the first and second corner reinforcements include first and second threaded bores, respectively; first and second adjustment screws operable to be threaded into and through the threaded bores; and first and second end fastener plates slidingly receivable into the first and second end panels, respectively, where: the first and second end fastener plates include first and second horizontal slots sized to receive the first and second threaded rods, respectively; the first and second end fastener plates each include first and second vertical slots; and a flange extending downward from the back panel; and extending horizontally outward from the back panel by a length equal to a thickness of a sidewall of the cabinet. The cabinet, further including a attachment panel coupled between the first and second side panels, where the attachment panel includes at least three horizontal slots in a staggered arrangement in at least two horizontal rows. The cabinet, further including a removable top panel.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figure 1:
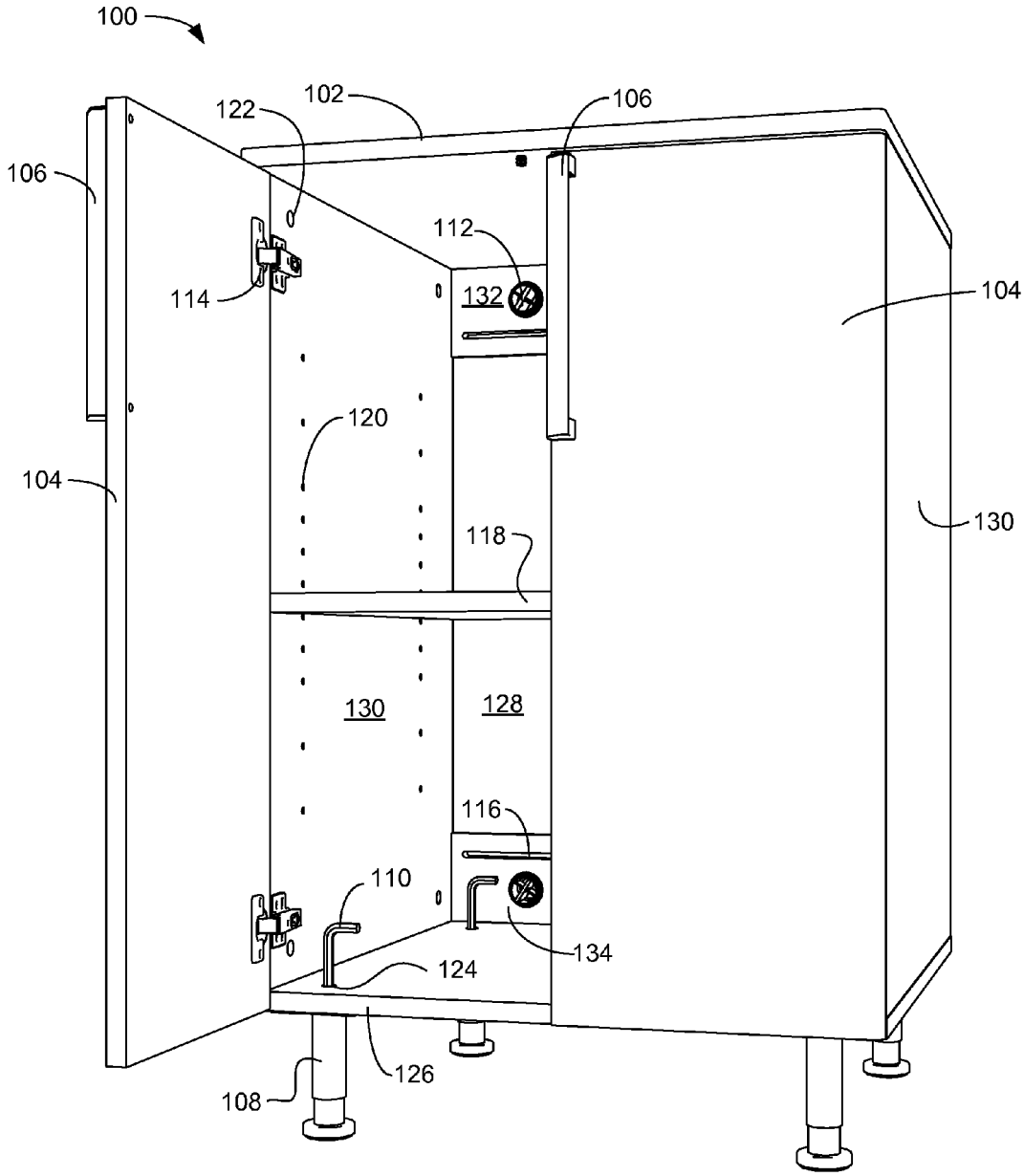
FIG. 1 is a front perspective view illustrating an exemplary cabinet of an exemplary garage storage system, according to a preferred embodiment of the present invention.

FIG. 1 is a front perspective view illustrating an exemplary cabinet 100 of an exemplary garage storage system, according to a preferred embodiment of the present invention. The garage storage system of the present invention includes three exemplary cabinets 100, 2600, and 3200 intended to be secured to a wall that have in common the use of novel adjustment panels 132, 134, and 2610 (which are similar) for adjusting a cabinet 100, 2600, and 3200 to a level position by adjustable engagement with a wall. Two novel leveling devices, adjustable foot 108 and bracket 3202 are also used.

Cabinet 100 has a bottom panel 126, a back panel 128, adjustment panel 132, adjustment panel 134, a removable top panel 102, and two side panels 130. Cabinet 100 has a closure including two doors 104 with left and right handles 106 and hinges 114 (one of two in this view labeled). Cabinet 100 has internally adjustable legs 108 (one of four labeled), and hinged 114 doors 104 with left and right handles 106. Handles 106 are placed proximate the top edge of cabinet 100 so that an upper cabinet module 2604 (see FIG. 29C) or 3200 (see FIG. 33 may be stacked on cabinet 100 (with top 102 removed) and left and right handles 106 may be mechanically linked to left and right handles 2950 and 2952 or 3302 and 3301, respectively, of the upper cabinet module 2604. Cam locks 122 (one of four in this view labeled) releasably engage lockable pins, similar to pins 208 (see FIG. 2) to couple side panel 130 to top panel 102 and bottom panel 126. Preferably, cam locks 122 are accessible only from inside the cabinet 100. While cam locks are preferred, other pin locking mechanisms may be used in various alternate embodiments. Removable Allen wrenches 110 (one of two in this view labeled) may be used to adjust the height of each adjustable foot 108 by extending through holes 124 (one of two in this view labeled) in bottom panel 126 to rotationally engage foot 108. Adjusting the heights of feet 108 assists in establishing side-to- side leveling. Adjustable standoffs 112 (one of two in this view labeled) adjust contact with a wall (not shown), such as a garage wall, behind the cabinet 100, in order to establish back-to front leveling and to resist the tendency of fasteners (such as screws) through slots 116 to pull the cabinet 100 toward the wall. Slots 116 (one of two in this view labeled) in adjustment panels 132 and 134 enable fasteners (not shown) to be passed through to connect to the wall. Cabinet 100 is thus leveled by controls 110, 112 that are entirely within the cabinet 100.

Figure 2:
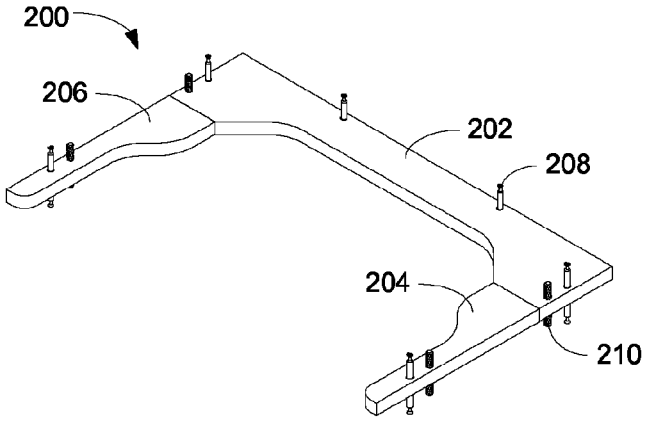
FIG. 2 is a front perspective view illustrating an exemplary adapter of an exemplary garage storage system, according to a preferred embodiment of the present invention.

FIG. 2 is a front perspective view illustrating an exemplary adapter 200 of an exemplary garage storage system, according to a preferred embodiment of the present invention. Adapter 200 substitutes for the top panel 102 of cabinet 100 when stacking an upper modular cabinet 2604 is desired. Adapter 200 comprises three pieces: a center piece 202, a left wing 206 and a right wing 204. Lockable pins 208 (one of nine labeled) and dowels 210 (one of four labeled) connect modular cabinets 100, 2604 above and below the adapter by being inserted into holes drilled vertically in the sides and back of cabinet 100 and upper modular cabinet 2604. Lockable pins 208 are engaged by cam locks 122 to in the cabinet 100 and in the upper modular cabinet 2604. The shape of the adapter 200 is functional for meeting the stresses in stacked modular cabinets 100, 2604.

Figure 3:
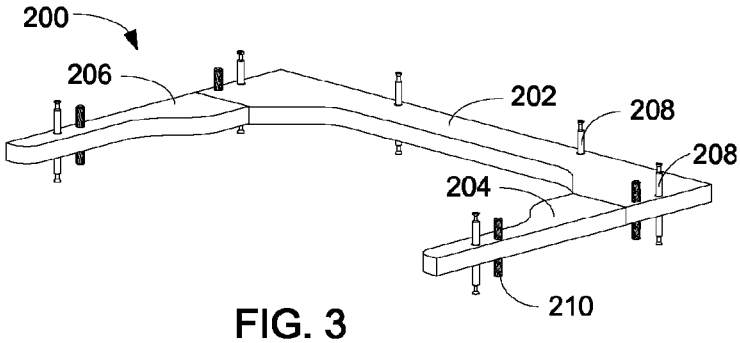
FIG. 3 is a front perspective view illustrating an exemplary adapter of an exemplary garage storage system, according to a preferred embodiment of FIG. 2.

FIG. 3 is a front perspective view illustrating an exemplary adapter 200 of an exemplary garage storage system, according to a preferred embodiment of FIG. 2. Top and bottom lockable pins 208 (two of eleven in this view labeled) are arranged pair-wise above and below, while dowels 210 go through the center piece 202, left wing 206, and right wing 204.

Figure 4:
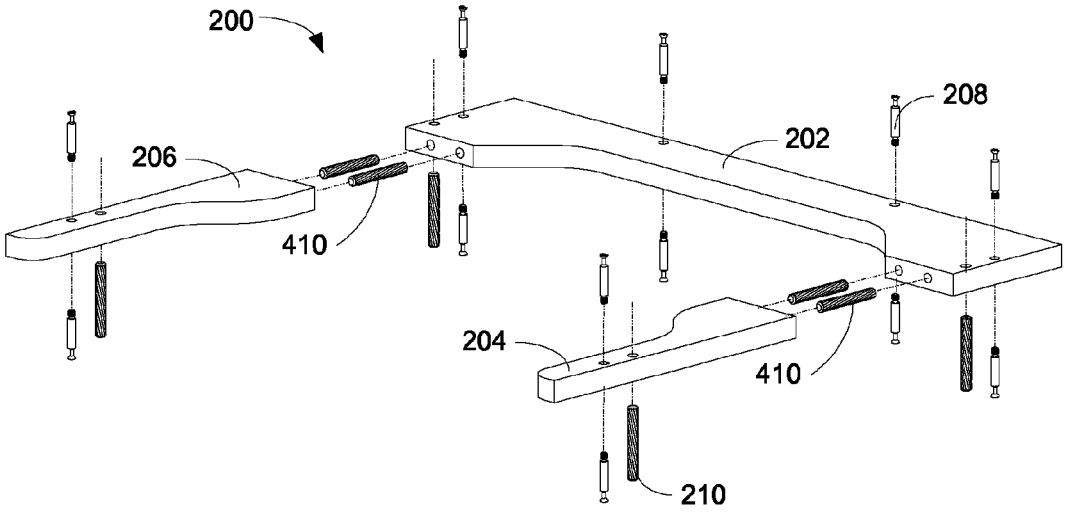
FIG. 4 is a front perspective exploded view illustrating an exemplary adapter of an exemplary garage storage system, according to a preferred embodiment of FIG. 2.

FIG. 4 is a front perspective exploded view illustrating an exemplary adapter 200 of an exemplary garage storage system, according to a preferred embodiment of FIG. 2. Dowels 410, (two of four labeled) are used to fasten right and left wings 204 and 206 to centerpiece 202. Preferably, and adhesive is also used on the dowels and the meeting surfaces between the left and right wings 206 and 204 and the centerpiece 202.

Figure 5:
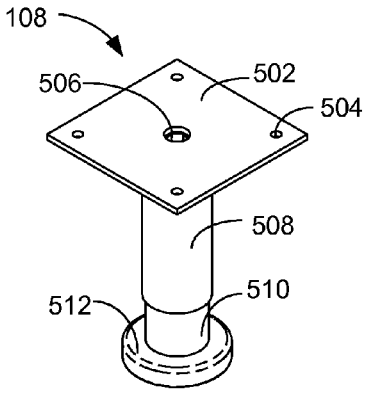
FIG. 5 is a front perspective view illustrating an exemplary foot of an exemplary garage storage system, according to a preferred embodiment of the present invention.

FIG. 5 is a front perspective view illustrating an exemplary foot 108 of an exemplary garage storage system, according to a preferred embodiment of the present invention. Fastening plate 502 has fastener holes 504 (one of four labeled) and a central opening 506. Fastening plate 502 is rigidly fixed to sleeve 508 which slidingly receives shell 510 which, in turn, is of one piece with base 512. In assembly, central opening 506 of foot 108 is aligned to a hole 124 in bottom panel 126 and fasteners (not shown) fasten fastening plate 502 to the underside of cabinet bottom panel 126 through fastener holes 504. In a particular embodiment, cabinet 100 may have only two feet 108, located near the front, as the cabinet 100 is fastened to a wall.

Figure 6:
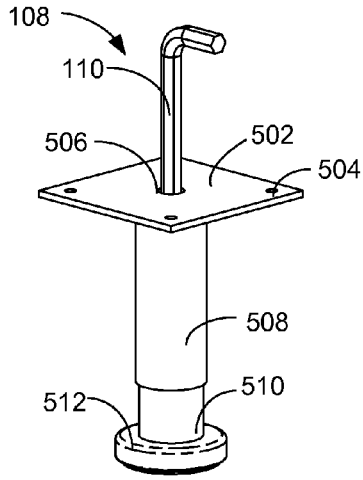
FIG. 6 is a front perspective view illustrating an exemplary foot of an exemplary garage storage system, according to a preferred embodiment of FIG. 5.

FIG. 6 is a front perspective view illustrating an exemplary foot 108 of an exemplary garage storage system, according to a preferred embodiment of FIG. 5. Allen wrench 110 is shown intruded into opening 506 for temporary use in adjusting the height of foot 108. In normal operation, the Allen wrench 110 is inserted through hole 124 and into aligned central opening 506 to adjust the height of each foot 108. In various alternate embodiment, various other torque delivery and torque-receiving mechanisms may be used in place of the Allen wrench 110 and Allen socket 802 (see FIG. 8).

Figure 7:
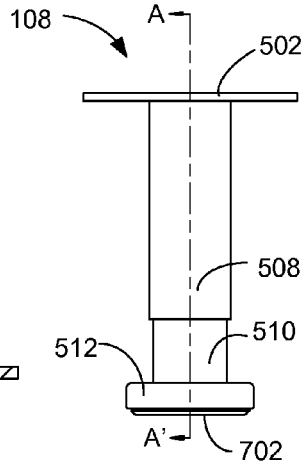
FIG. 7 is a front elevation view illustrating an exemplary foot of an exemplary garage storage system and defining cross-section A-A', according to a preferred embodiment of FIG. 5.

FIG. 7 is a front elevation view illustrating an exemplary foot 108 of an exemplary garage storage system and defining cross-section A-A', according to a preferred embodiment of FIG. 5. Fastening plate 502 and sleeve 508 may be welded together. Frictional bottom cap 702 preferably threads into base 512 and provides a high-friction bottom surface to the base 512.

Figure 8:
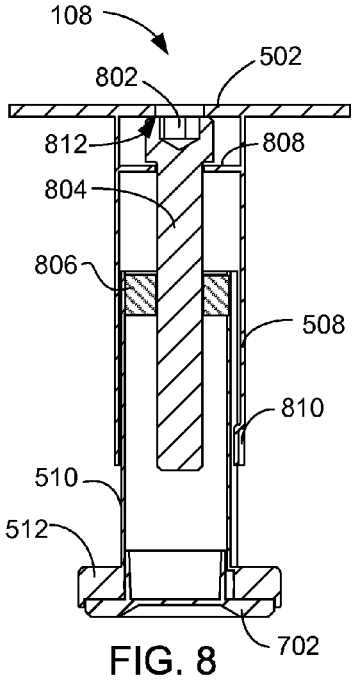
FIG. 8 is a cross-sectional view along cross-section A-A' illustrating an exemplary foot of an exemplary garage storage system, according to a preferred embodiment of FIG. 5.

FIG. 8 is a cross-sectional view along cross-section A-A' illustrating an exemplary foot 108 of an exemplary garage storage system, according to a preferred embodiment of FIG. 5. Allen wrench socket 802 snugly receives Allen wrench 110 when adjustments are needed. Allen wrench socket 802 is in bolt 804, which threadingly rotates in captive nut 806 which is captive inside shell 510, when torqued with Allen wrench 110. The boundary 812 between bolt 804 and fastening plate 502 is not fixed, so rotation of bolt 804 may raise or lower fastening plate 502 relative to shell 510. Captive washer 808, which is captive in sleeve 508, prevents the head of bolt 804 from loosing contact with fastening plate 502. Base 512 threadingly receives bottom cap 702. Latch 810 prevents overextension of the foot 108 and acts as a key that prevents shell 510 from rotating relative to sleeve 508 during height adjustment of foot 108.

Figure 9:
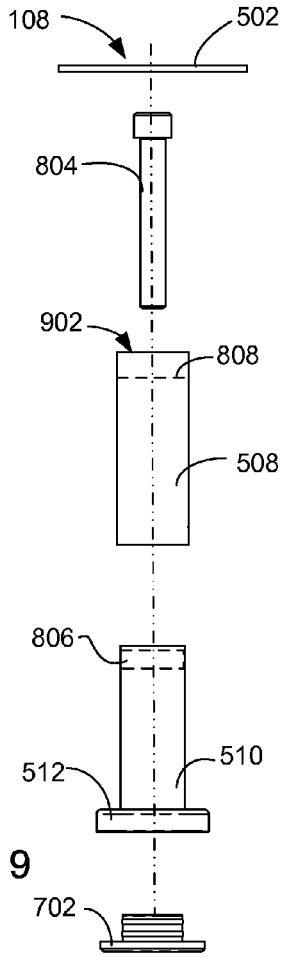
FIG. 9 is a front elevation exploded view illustrating an exemplary foot of an exemplary garage storage system, according to a preferred embodiment of FIG. 5.

FIG. 9 is a front elevation exploded view illustrating an exemplary foot 108 of an exemplary garage storage system, according to a preferred embodiment of FIG. 5. In assembly, bolt 804 enters shell 510, then sleeve 508 is lowered over shell 510, then fastener plate 502 is welded onto the top edge 902 of sleeve 508, and bottom cap 702 is screwed in.

Figure 10:
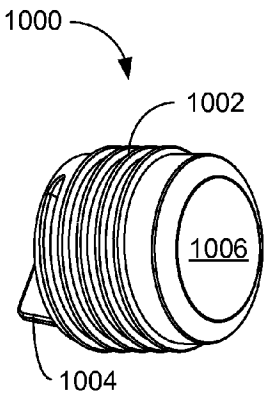
FIG. 10 is a front-side perspective view illustrating an exemplary hand screw of an exemplary standoff adjuster of an exemplary garage storage system, according to a preferred embodiment of the present invention.

FIG. 10 is a front-side perspective view illustrating an exemplary hand screw 1000 of an exemplary standoff adjuster 112 of an exemplary garage storage system, according to a preferred embodiment of the present invention. Fin 1004 is used to manually rotate threaded 1002 hand screw 1000 within internally threaded hand screw sleeve 1100 (see FIG. 11) to push surface 1006 against a wall behind the cabinet to establish back-to-front leveling.

Figure 11:
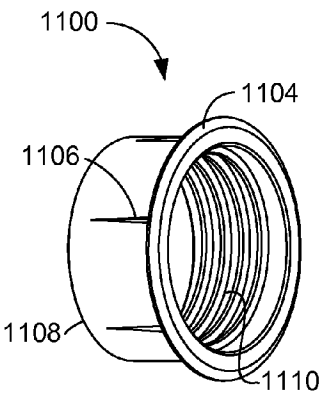
FIG. 11 is a front-side perspective view illustrating an exemplary hand screw sleeve of an exemplary standoff adjuster of an exemplary garage storage system, according to a preferred embodiment of FIG. 10.

FIG. 11 is a front-side perspective view illustrating an exemplary hand screw sleeve 1100 of an exemplary standoff adjuster 112 of an exemplary garage storage system, according to a preferred embodiment of FIG. 10. Internally threaded 1110 hand screw sleeve 1100 features a flange 1104 and ribs 1106 for fitting into a drilled opening in the back of a cabinet, such as cabinet 100 or more preferably, through the back of an adjustment panel 132. In installation, the hand screw sleeve 1100 is inserted from the outside of the cabinet 100 or adjustment panel 132 with the flange 1104 limiting the extent of insertion. Preferably, the length of the hand screw sleeve 1100 from the underside of the flange 1104 to the distal edge 1108 is no greater than the thickness of the cabinet back wall 128 or the thickness of the adjustment panel 132, as appropriate for the particular installation.

Figure 12:
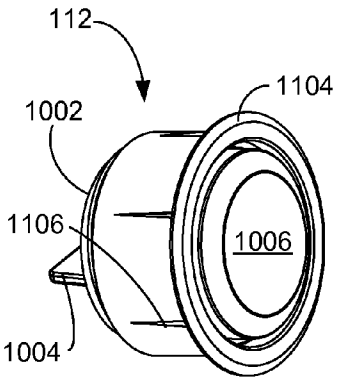
FIG. 12 is a front-side perspective view illustrating an exemplary standoff adjuster of an exemplary garage storage system, according to a preferred embodiment of FIG. 10.
Figure 13:
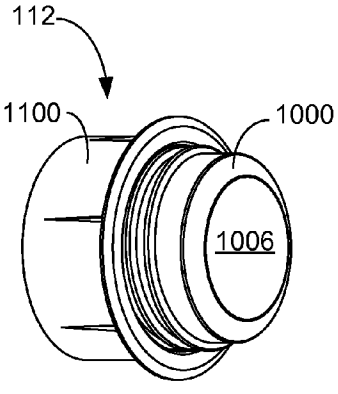
FIG. 13 is a front-side perspective view illustrating an exemplary standoff adjuster of an exemplary garage storage system, according to a preferred embodiment of FIG. 10.

FIG. 12 is a front-side perspective view illustrating an exemplary standoff adjuster 112 of an exemplary garage storage system, according to a preferred embodiment of FIG. 10. Exemplary hand screw 1000 and hand screw sleeve 1100 together form exemplary standoff adjuster 112. Surface 1006 is extendable, via screw action, beyond the plane of the flange 1104, in order to push the cabinet 100 into a level orientation in the back-and-forth direction FIG. 13 is a front-side perspective view illustrating an exemplary standoff adjuster 112 of an exemplary garage storage system, according to a preferred embodiment of FIG. 10. By rotating fin 1004 manually, various degrees of extension of surface 1006 may be obtained order to push the cabinet 100 into a level orientation in the back-and-forth direction.

Figure 14:
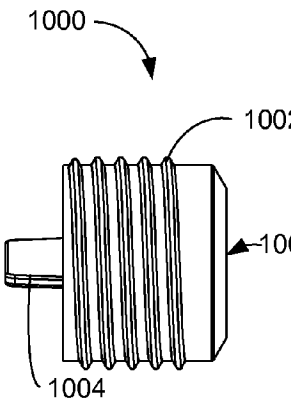
FIG. 14 is a side elevation view illustrating an exemplary hand screw of an exemplary standoff adjuster of an exemplary garage storage system, according to a preferred embodiment of FIG. 10.

FIG. 14 is a side elevation view illustrating an exemplary hand screw 1000 of an exemplary standoff adjuster of an exemplary garage storage system, according to a preferred embodiment of FIG. 10. In various alternate embodiments, threads 1002 of various pitches and gauge, corresponding to threads 1110, may be used. In a particular embodiment, the length of hand screw 1000 may be larger than the illustrated example.

Figure 15:
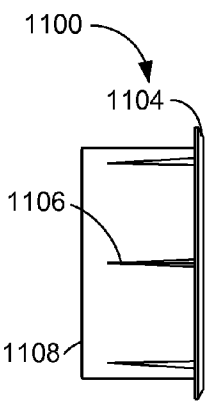
FIG. 15 is a side elevation view illustrating an exemplary hand screw sleeve of an exemplary standoff adjuster of an exemplary garage storage system, according to a preferred embodiment of FIG. 10.

FIG. 15 is a side elevation view illustrating an exemplary hand screw sleeve 1100 of an exemplary standoff adjuster of an exemplary garage storage system, according to a preferred embodiment of FIG. 10. In various alternate embodiments, different numbers of ribs 1106 may be used.

Figure 16:
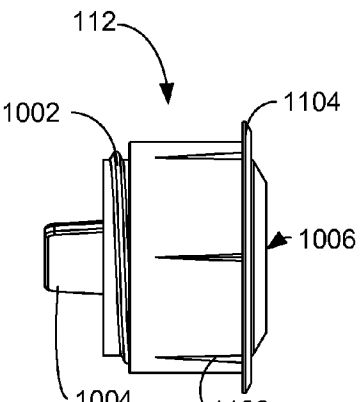
FIG. 16 is a side elevation view illustrating an exemplary standoff adjuster of an exemplary garage storage system, according to a preferred embodiment of FIG. 10.

FIG. 16 is a side elevation view illustrating an exemplary standoff adjuster 112 of an exemplary garage storage system, according to a preferred embodiment of FIG. 10. Hand screw 1000 is shown only slightly extended out of hand screw sleeve 1100. Compare with FIG. 17.

Figure 17:
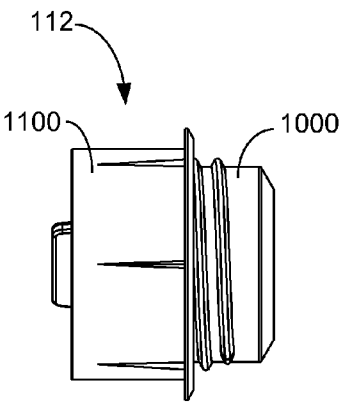
FIG. 17 is a side elevation view illustrating an exemplary standoff adjuster of an exemplary garage storage system, according to a preferred embodiment of FIG. 10.

FIG. 17 is a side elevation view illustrating an exemplary standoff adjuster 112 of an exemplary garage storage system, according to a preferred embodiment of FIG. 10. Hand screw 1000 is shown only extended farther out of hand screw sleeve 1100. Compare with FIG. 16.

Figure 18:
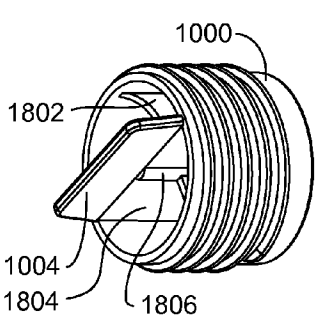
FIG. 18 is a side perspective view illustrating an exemplary hand screw of an exemplary standoff adjuster of an exemplary garage storage system, according to a preferred embodiment of FIG. 10.

FIG. 18 is a side perspective view illustrating an exemplary hand screw 1000 of an exemplary standoff adjuster 112 of an exemplary garage storage system, according to a preferred embodiment of FIG. 10. Hand screw 1000 is preferably not solid, but includes internal axle 1806 from which extend fin flanges 1804 and bracing flanges 1802.

Figure 19:
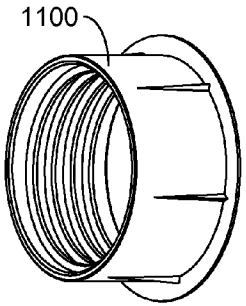
FIG. 19 is a side perspective view illustrating an exemplary hand screw sleeve of an exemplary standoff adjuster of an exemplary garage storage system, according to a preferred embodiment of FIG. 10.

FIG. 19 is a side perspective view illustrating an exemplary hand screw sleeve 1100 of an exemplary standoff adjuster 112 of an exemplary garage storage system, according to a preferred embodiment of FIG. 10.

Figure 20:
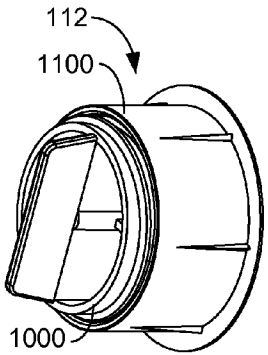
FIG. 20 is a side perspective view illustrating an exemplary standoff adjuster of an exemplary garage storage system, according to a preferred embodiment of FIG. 10.

FIG. 20 is a side perspective view illustrating an exemplary standoff adjuster 112 of an exemplary garage storage system, according to a preferred embodiment of FIG. 10. Hand screw 1000 is shown in a first position in hand screw sleeve 1100. Compare FIG. 21.

Figure 21:
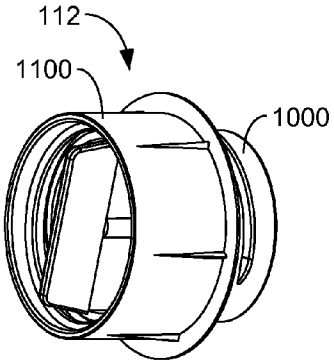
FIG. 21 is a side perspective view illustrating an exemplary standoff adjuster of an exemplary garage storage system, according to a preferred embodiment of FIG. 10.

FIG. 21 is a side perspective view illustrating an exemplary standoff adjuster 112 of an exemplary garage storage system, according to a preferred embodiment of FIG. 10. Hand screw 1000 is shown in a second position in hand screw sleeve 1100. Compare FIG. 20.

Figure 22:
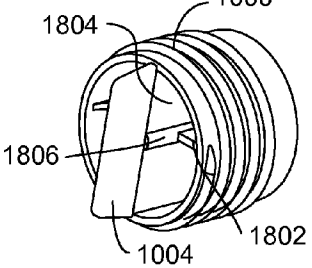
FIG. 22 is a side-rear perspective view illustrating an exemplary hand screw of an exemplary standoff adjuster of an exemplary garage storage system, according to a preferred embodiment of FIG. 10.

FIG. 22 is a side-rear perspective view illustrating an exemplary hand screw 1000 of an exemplary standoff adjuster 112 of an exemplary garage storage system, according to a preferred embodiment of FIG. 10.

Figure 23:
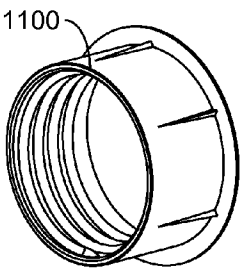
FIG. 23 is a side-rear perspective view illustrating an exemplary hand screw sleeve of an exemplary standoff adjuster of an exemplary garage storage system, according to a preferred embodiment of FIG. 10.

FIG. 23 is a side-rear perspective view illustrating an exemplary hand screw sleeve 1100 of an exemplary standoff adjuster 112 of an exemplary garage storage system, according to a preferred embodiment of FIG. 10.

Figure 24:
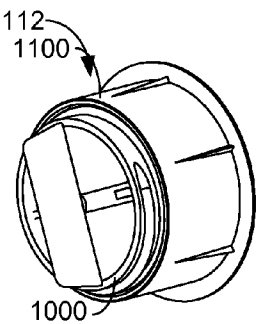
FIG. 24 is a side-rear perspective view illustrating an exemplary standoff adjuster of an exemplary garage storage system, according to a preferred embodiment of FIG. 10.

FIG. 24 is a side-rear perspective view illustrating an exemplary standoff adjuster 112 of an exemplary garage storage system, according to a preferred embodiment of FIG. 10. Hand screw 1000 is shown in a first position in hand screw sleeve 1100. Compare FIG. 25.

Figure 25:
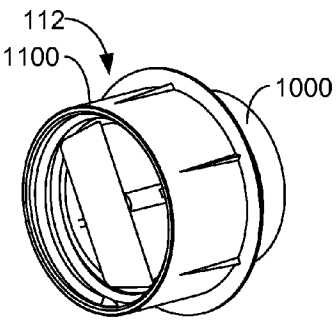
FIG. 25 is a side-rear perspective view illustrating an exemplary standoff adjuster of an exemplary garage storage system, according to a preferred embodiment of FIG. 10.

FIG. 25 is a side-rear perspective view illustrating an exemplary standoff adjuster 112 of an exemplary garage storage system, according to a preferred embodiment of FIG. 10. Hand screw 1000 is shown in a second position in hand screw sleeve 1100. Compare FIG. 24.

Figure 26:
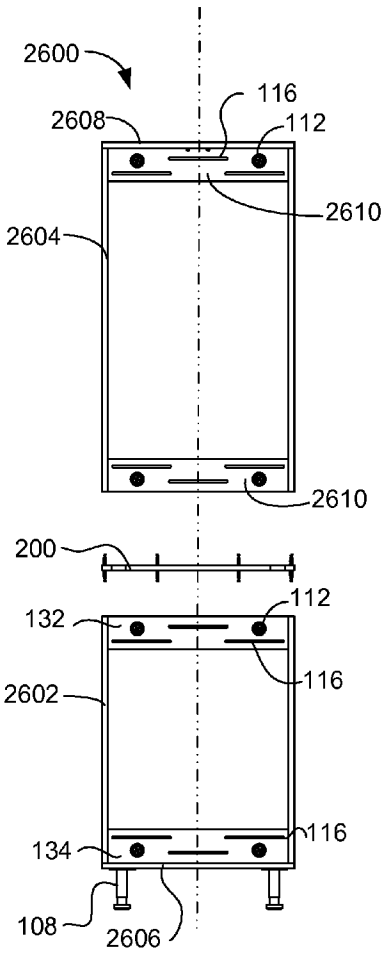
FIG. 26 is a front elevation exploded view illustrating an exemplary modular stacked cabinet of an exemplary garage storage system, according to a preferred embodiment of the present invention.

FIG. 26 is a front elevation exploded view illustrating an exemplary modular stacked cabinet 2600 of an exemplary garage storage system, according to a preferred embodiment of the present invention. Lower cabinet module 2602 (cabinet 100 without top 102) has four legs 108 and a bottom 2606. Upper cabinet module 2604 has no bottom but has a top 2608. Adapter 200 will connect upper cabinet module 2604 to lower cabinet module 2602 using locking pins 208 and cam locks 122, as well as dowels 210. Adjustment panels 2610, 132, and 134 are used to attach the cabinet 2600 to the wall through slots 116 (three of twelve labeled) and to adjust back-to-front leveling using standoff adjusters 112 (two of eight labeled). Preferably, leveling adjustments are performed before attaching the modular stacked cabinet 2600 to the garage wall or other vertical surface.

Figure 27:
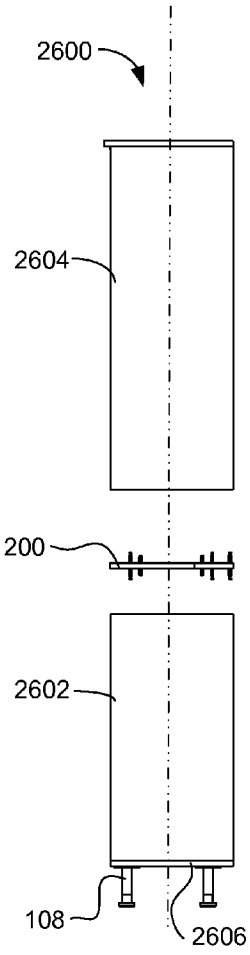
FIG. 27 is a side elevation exploded view illustrating an exemplary modular stacked cabinet of an exemplary garage storage system, according to a preferred embodiment of FIG. 26.

FIG. 27 is a side elevation exploded view illustrating an exemplary modular stacked cabinet 2600 of an exemplary garage storage system, according to a preferred embodiment of FIG. 26.

Figure 28:
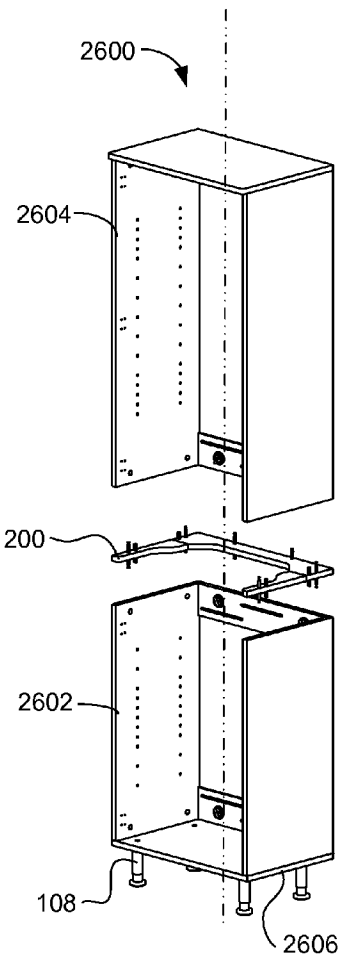
FIG. 28 is a side-front perspective exploded view illustrating an exemplary modular stacked cabinet of an exemplary garage storage system, according to a preferred embodiment of FIG. 26.

FIG. 28 is a side-front perspective exploded view illustrating an exemplary modular stacked cabinet 2600 of an exemplary garage storage system, according to a preferred embodiment of FIG. 26.

Figure 29B:
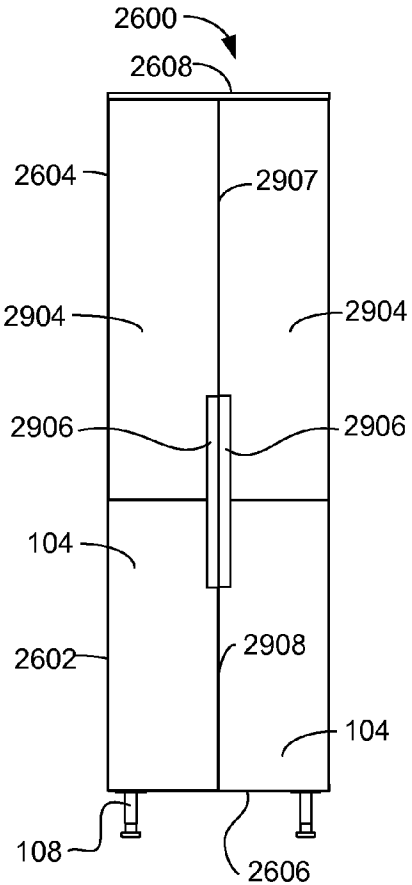
FIG. 29B is a front elevation view illustrating an exemplary modular stacked cabinet of an exemplary garage storage system, according to a preferred embodiment of FIG. 26.
Figure 29A:
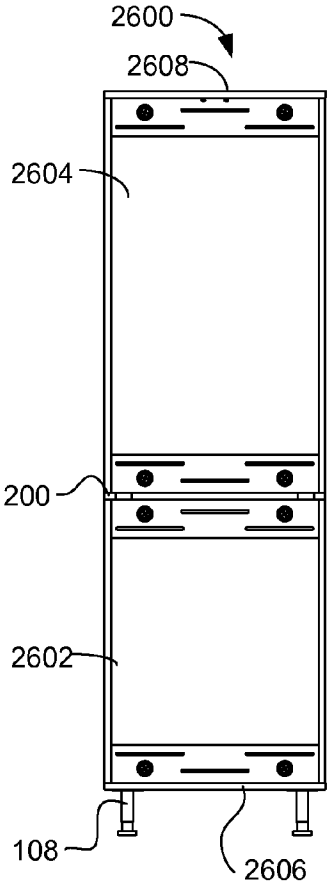
FIG. 29A is a front elevation view illustrating an exemplary modular stacked cabinet of an exemplary garage storage system, according to a preferred embodiment of FIG. 26.

FIG. 29A is a front elevation view illustrating an exemplary modular stacked cabinet 2600 of an exemplary garage storage system, according to a preferred embodiment of FIG. 26. The modular stacked cabinet 2600 is shown in its assembled configuration, but without the doors 104 and 2904 (see FIG. 29B) and without shelves 118.

Figure 29C:
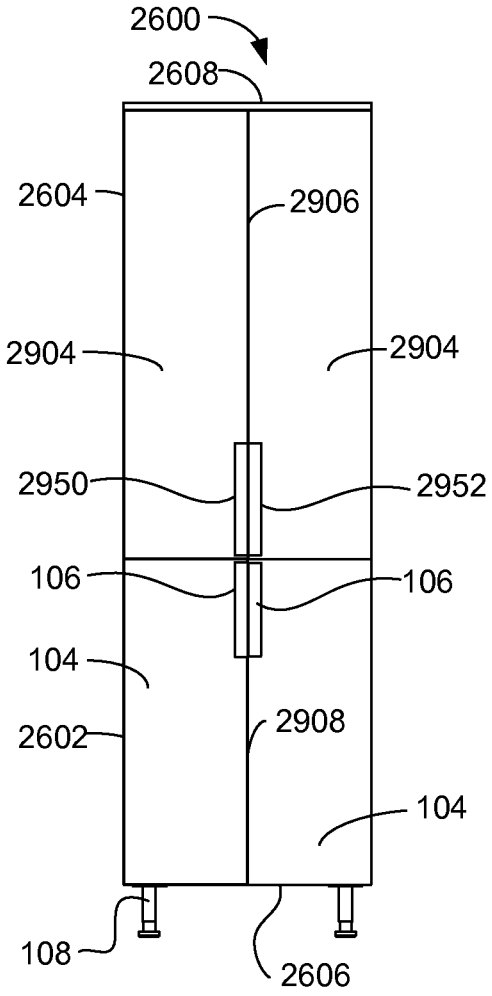
FIG. 29C is a front elevation view illustrating an exemplary modular stacked cabinet of an exemplary garage storage system without handle connectors, according to a preferred embodiment of FIG. 26.

FIG. 29B and FIG. 29C are front elevation views illustrating an exemplary modular stacked cabinet 2600 of an exemplary garage storage system, according to a preferred embodiment of FIG. 26. The modular stacked cabinet 2600 is shown in its assembled configuration, with bi-fold doors 104 and 2904 and bi-fold door closure seams 2908 and 2907, respectively. Door handle couplings 2906, illustrated as sleeves 2906, attach to left and right handles 106 and to left and right handles 2950 and 2952 (see FIG. 29C), respectively, on the upper modular cabinet 2604 and are sufficiently rigid to enable the left door combination 104 and 2904 to open and close as one door, and to allow the right door combination 104 and 2904 to open and close as one door. Handles 2950 and 2952 for the upper modular cabinet 2604 are identical to handles 106, except that they are placed at the lower end of the bi-fold doors 2904. Handles 106 preferably have ridges along both sides, enabling door handle couplings 2906, illustrated as sleeves 2906, to be slid or snapped onto the aligned handles 2650 to 106 (left) and 2952 to 106(right).

Figure 30:
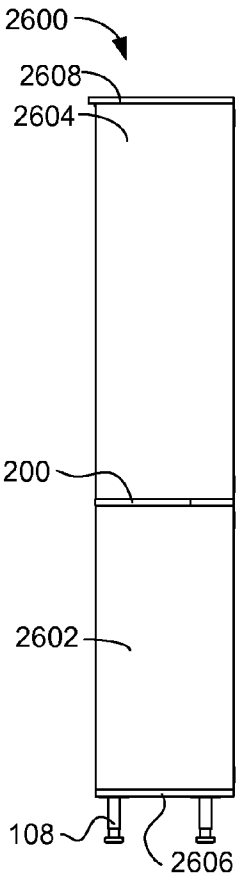
FIG. 30 is a side elevation view illustrating an exemplary modular stacked cabinet of an exemplary garage storage system, according to a preferred embodiment of FIG. 26.

FIG. 30 is a side elevation view illustrating an exemplary modular stacked cabinet 2600 of an exemplary garage storage system, according to a preferred embodiment of FIG. 26. FIG. 30 is shown without doors 2904 or 104. The relative heights of the lower cabinet 2602 and upper modular cabinet 2604 are not a limitation of the invention, nor is there a limit on the number of modular cabinet units that may be stacked.

Figure 31:
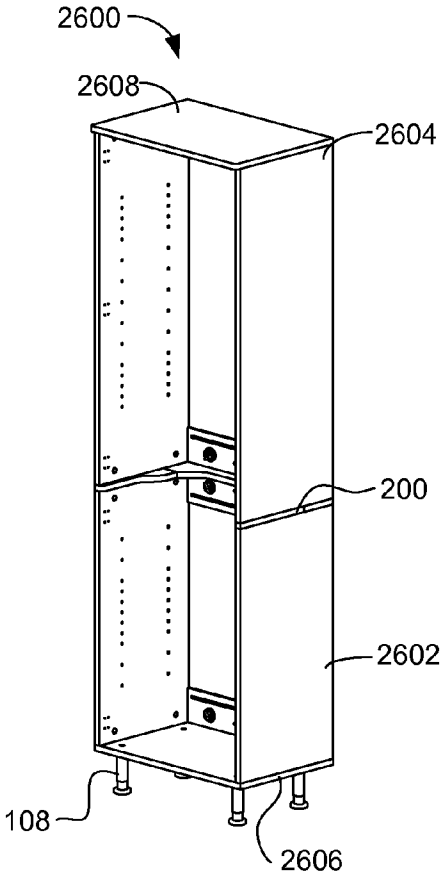
FIG. 31 is a side-front perspective view illustrating an exemplary modular stacked cabinet of an exemplary garage storage system, according to a preferred embodiment of FIG. 26.

FIG. 31 is a side-front perspective view illustrating an exemplary modular stacked cabinet 2600 of an exemplary garage storage system, according to a preferred embodiment of FIG. 26. FIG. 30 is shown without doors 2904 or 104.

Figures 32, 33, 34, 35, 36, 37:
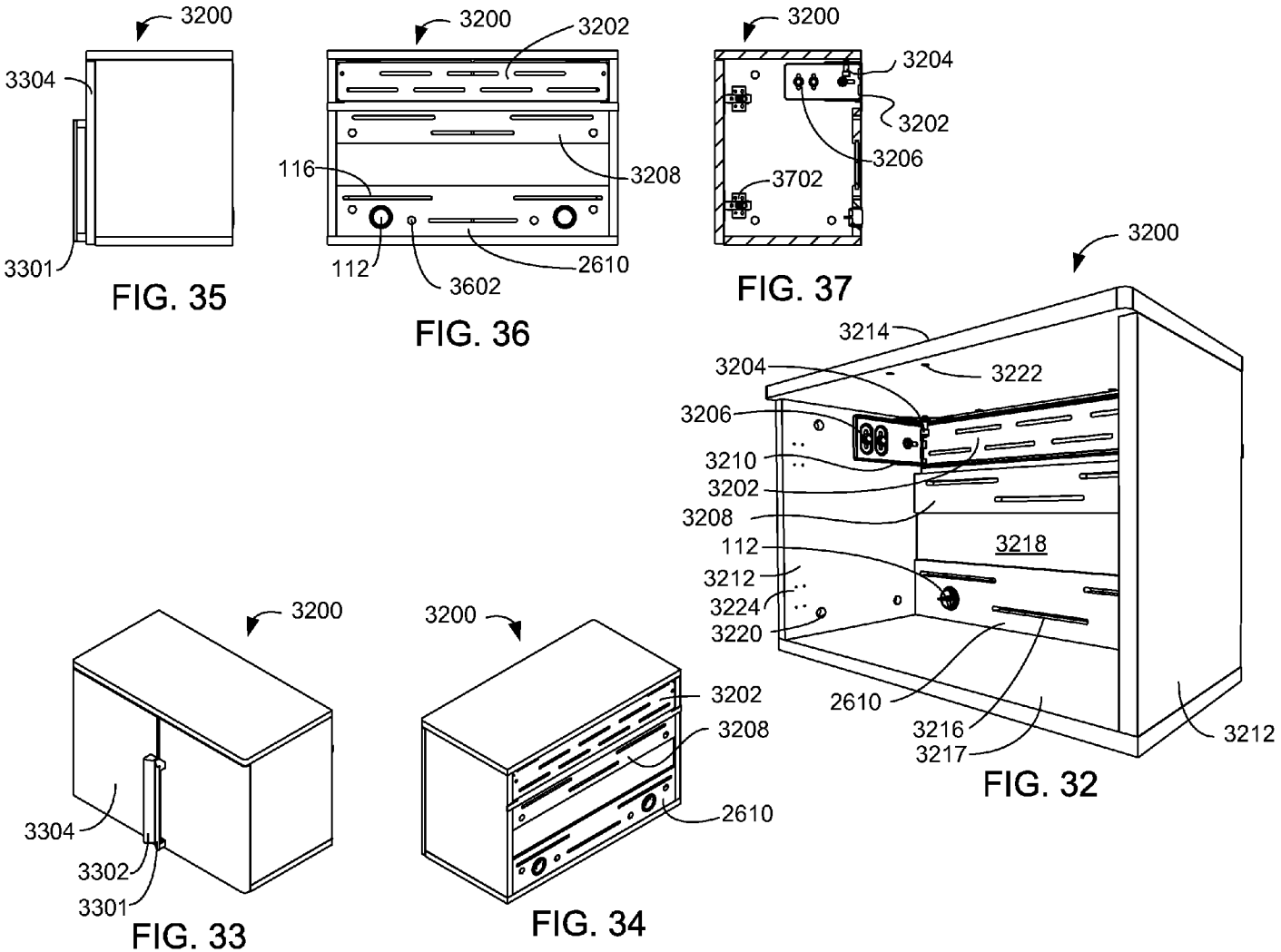
FIG. 32 is a front-side perspective view illustrating an exemplary wall-hanging cabinet of an exemplary garage storage system, according to a preferred embodiment of the present invention.
FIG. 33 is a front-side perspective view illustrating an exemplary wall-hanging cabinet of an exemplary garage storage system, according to a preferred embodiment of FIG. 32.
FIG. 34 is a rear-side perspective view illustrating an exemplary wall-hanging cabinet of an exemplary garage storage system, according to a preferred embodiment of FIG. 32.
FIG. 35 is a side elevation view illustrating an exemplary wall-hanging cabinet of an exemplary garage storage system, according to a preferred embodiment of FIG. 32.
FIG. 36 is a rear elevation view illustrating an exemplary wall-hanging cabinet of an exemplary garage storage system, according to a preferred embodiment of FIG. 32.
FIG. 37 is a side elevation x-ray view illustrating an exemplary wall-hanging cabinet of an exemplary garage storage system, according to a preferred embodiment of FIG. 32.

FIG. 32 is a front-side perspective view illustrating an exemplary wall-hanging cabinet 3200 of an exemplary garage storage system, according to a preferred embodiment of the present invention. Cabinet doors 3304 (see FIG. 33) are omitted in this view. Wall-hanging cabinet 3200 has a bottom panel 3217, a back panel 3218, a top panel 3214, and two side panels 3212. Wall-hanging cabinet 3200 also has a bracket 3202 that attaches to the garage wall, or other vertical surface, and has side extensions 3210 that adjustably attach to the inside of side walls 3212 of cabinet 3200. Corner adjustment screws 3204 may be operated within the cabinet 3200 to establish side-to-side leveling, while standoff adjusters 112 are used for back-to-front leveling. Fasteners in slots 3206 fix the cabinet 3200 side wall 3212 to the bracket 3202 once adjustment is complete. Further attachment may be made through attachment panel 3208 and adjustment panel 2610 using slots 3216. Cam locks 3220 (one of three in this view labeled) are used with locking pins (not shown) to fasten side panels 3212 to top panel 3214 and bottom panel 3217. Magnetic door latches 3222 retain the bi-fold doors 3304 in a releasably closed position. Holes 3224 (one of eight in this view labeled) receive hinges 3702 of bi-fold doors 3304.

FIG. 33 is a front-side perspective view illustrating an exemplary wall-hanging cabinet 3200 of an exemplary garage storage system, according to a preferred embodiment of FIG. 32. Hinged 3702 (see FIG. 37) cabinet doors 3304 (one of two labeled) have left and right handles 3302 and 3301 which may be coupled to left and right handles 106, respectively, when cabinet 3200 is stacked on cabinet 2602. Cabinet doors 3304 are optional.

FIG. 34 is a rear-side perspective view illustrating an exemplary wall-hanging cabinet 3200 of an exemplary garage storage system, according to a preferred embodiment of FIG. 32. Adjustment panel 2610 holds two standoff adjusters 112 and three slots in staged arrangement of two rows. Attachment panel 3208 includes three slots in staged arrangement of two rows. Bracket 3202 includes seven slots in staggered arrangement of two rows.

FIG. 35 is a side elevation view illustrating an exemplary wall-hanging cabinet 3200 of an exemplary garage storage system, according to a preferred embodiment of FIG. 32. FIG. 35 includes the cabinet doors and handles 3302.

FIG. 36 is a rear elevation view illustrating an exemplary wall-hanging cabinet 3200 of an exemplary garage storage system, according to a preferred embodiment of FIG. 32. Adjustment panel 2610 holds two standoff adjusters 112 and three slots in staged arrangement of two rows. Attachment panel 3208 includes three slots in staged arrangement of two rows. Bracket 3202 includes seven slots in staggered arrangement of two rows. Cam locks 3602, (one of six labeled) receive locking pins (not shown) that connect adjustment panel 2610 to the bottom panel 3217 and side panels 3212.

FIG. 37 is a side elevation x-ray view illustrating an exemplary wall-hanging cabinet 3200 of an exemplary garage storage system, according to a preferred embodiment of FIG. 32. Hinges 3702 (one of two labeled) hold doors 3304. Side portions of bracket 3202 attach to inner wall surface and support corner adjustment screws 3204. Fasteners in slots 3206 in bracket 3202 enable the cabinet to be fixed to the bracket 3202 after adjustments.

Figure 38:
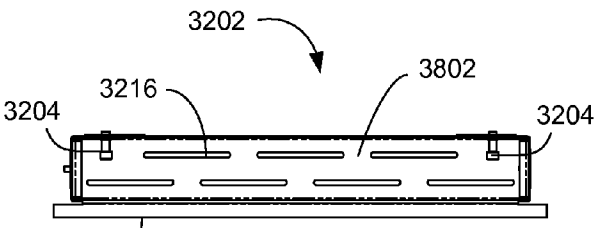
FIG. 38 is a front elevation view illustrating an exemplary bracket of an exemplary garage storage system, according to a preferred embodiment of FIG. 32.

FIG. 38 is a front elevation view illustrating an exemplary bracket 3202 of an exemplary garage storage system, according to a preferred embodiment of FIG. 32. Bracket 3202 includes back panel 3802 with seven slots 3216 (one labeled) in a staggered arrangement in two horizontal rows. Slots 3216 receive fasteners with heads, such as nails, screws, or bolts, for fastening the back panel 3802 to a garage wall. The staggered arrangement of slots 2316 enables fastening along the entire length of back panel 3802 without unacceptable weakening of the back panel 3802, as would occur with a single long slot. Flange 3804 is flush with the back surface of back panel 3802 and serves to prevent the bracket from moving into the cabinet 100, 2600, or 3200 by engaging the rear edges of exemplary side walls 3212 when the bracket is installed as in FIG. 32. Preferably, flange 3804 extends outward from the back panel 3802 by a length equal to the width of side panels 3212. During installation of wall cabinets 3200, the brackets 3202 are fastened to the wall first. When multiple wall-hanging cabinet 3200 are installed side-by-side at the same height, the ends of flanges 3804 for the multiple brackets 3202 are abutted, as the brackets 3202 are installed, to provide correct spacing between brackets 3202 to accommodate the thickness of side walls 3212.

Figure 39:
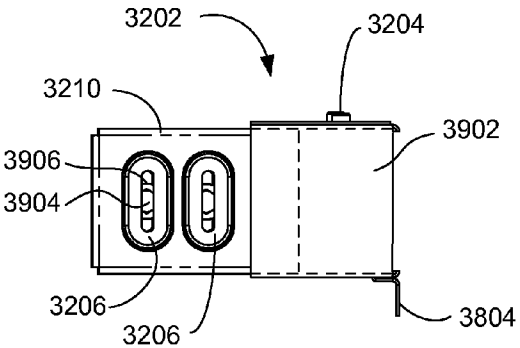
FIG. 39 is a side elevation view illustrating an exemplary bracket of an exemplary garage storage system, according to a preferred embodiment of FIG. 32.

FIG. 39 is a side elevation view illustrating an exemplary bracket 3202 of an exemplary garage storage system, according to a preferred embodiment of FIG. 32. End panel 3902 is preferably bent from the same piece of metal as used to make back panel 3802. End panel 3902 sliding receives, before installation is complete, end fastening plate 3210. End fastening plate 3210 includes two end fastening slots 3206 though which screw 3904 (one of two labeled) extends into side wall 3212. Washer 3906 (one of two labeled) assists in retaining the head of screw 3904. Adjustment screw 3204 may protrude above the end panel to engage the underside of top panel 3214 and may be adjusted for side-to side leveling. Flange 3804 may be made from L-bar with a portion of the horizontal wing removed outside of the width of the wall-hanging cabinet 3200.

Figure 40:
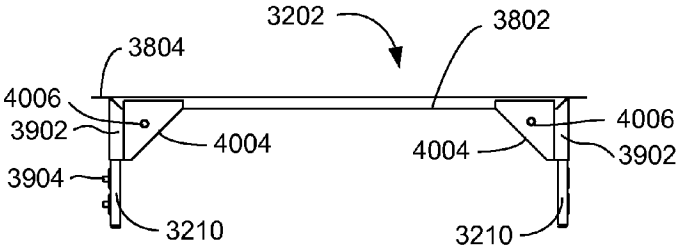
FIG. 40 is a top plan view illustrating an exemplary bracket of an exemplary garage storage system, according to a preferred embodiment of FIG. 32.

FIG. 40 is a top plan view illustrating an exemplary bracket 3202 of an exemplary garage storage system, according to a preferred embodiment of FIG. 32. Corner reinforcements 4004 rigidly connect the back panel 3802 with each end panel 3902. Each corner reinforcement 4004 has a threaded bore 4006 for receiving adjustment screws 3204. The threaded bore 4006 is preferably made by welding a nut to the underside of corner reinforcements 4004.

Figure 41:
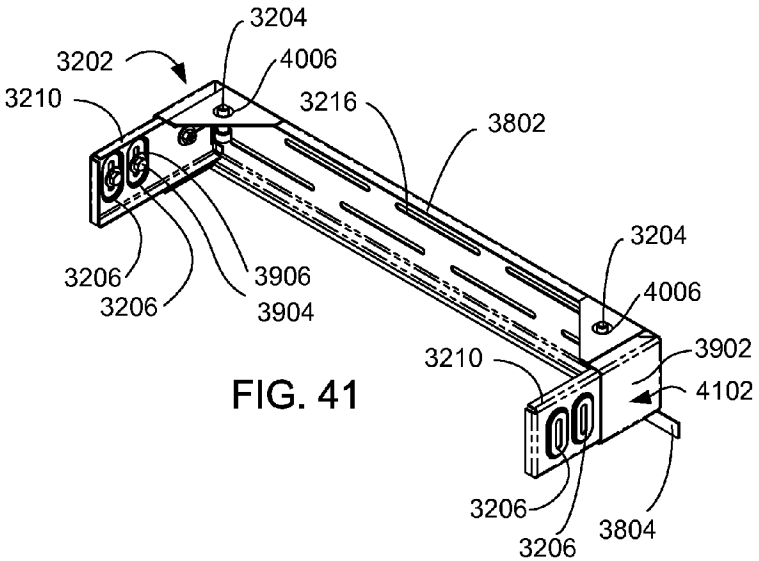
FIG. 41 is a top-front perspective view illustrating an exemplary bracket of an exemplary garage storage system, according to a preferred embodiment of FIG. 32.

FIG. 41 is a top-front perspective view illustrating an exemplary bracket 3202 of an exemplary garage storage system, according to a preferred embodiment of FIG. 32. Adjustment screws 3204 can be seen in threaded bores 4006. The surface 4102 of end panel 3902 abuts the inside of side wall 3212 when installed.

Figure 42:
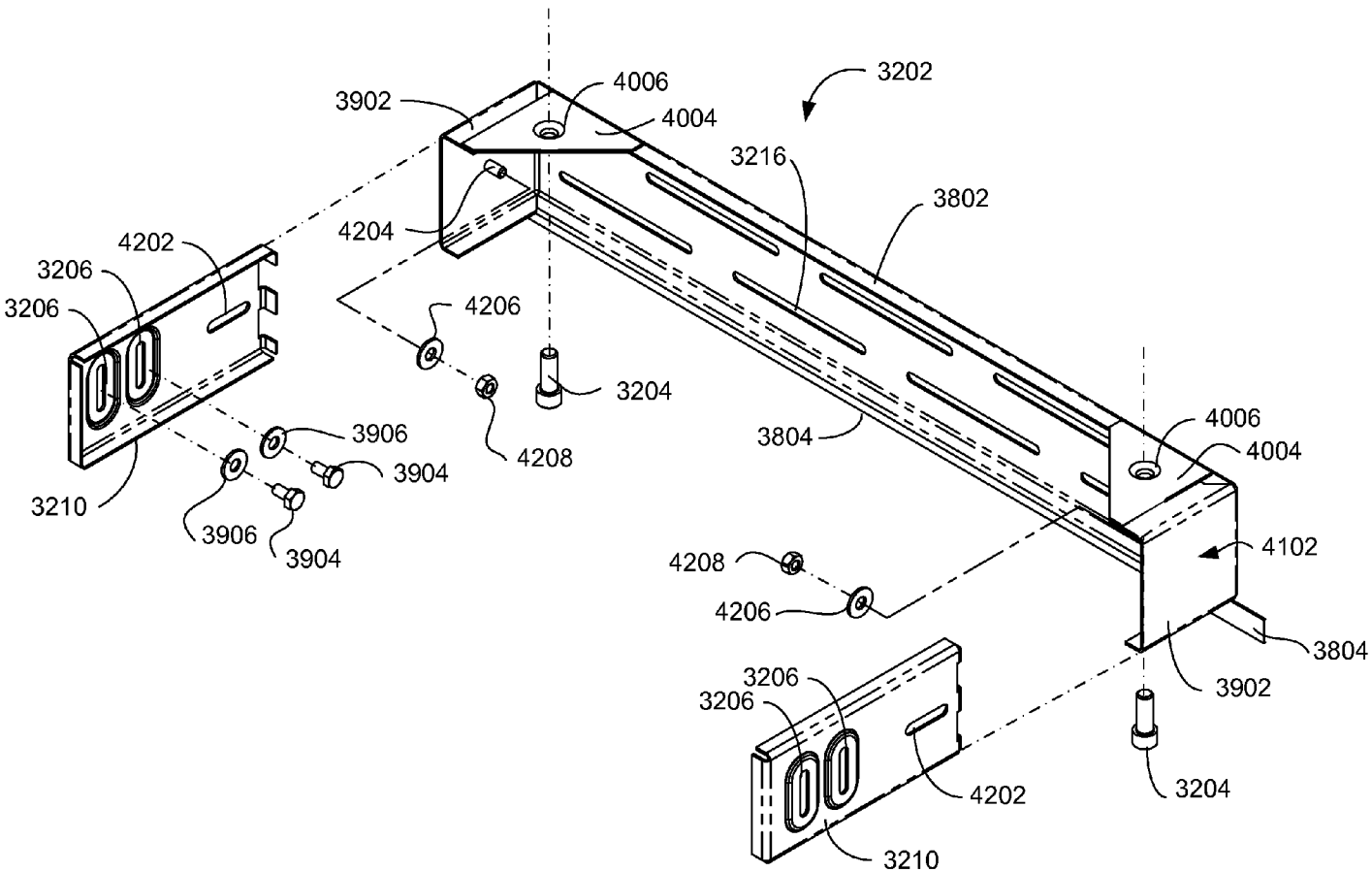
FIG. 42 is a top-front perspective exploded view illustrating an exemplary bracket of an exemplary garage storage system, according to a preferred embodiment of FIG. 32.

FIG. 42 is a top-front perspective exploded view illustrating an exemplary bracket 3202 of an exemplary garage storage system, according to a preferred embodiment of FIG. 32. Side slots 4202 in end fastener panels 3210 receive threaded rod 4204 (one of two visible in this view) for adjusting and the horizontal position of end fastening panel 3210 and then fixing that position using washer 4206 and nut 4208. Threaded rod 4204 is affixed to the inside surface of end panels 3902, as shown. Fastening nut 4208 on threaded rod 4202 connects end fastening plate 3210 to end panel 3802 and, indirectly, back panel 3802.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

We claim:

1. A cabinet securable to a wall, the cabinet comprising:

a. at least one adjustment panel, comprising:

i. at least one hand screw comprising a fin for manual operation installed through said adjustment panel; and ii. at least three horizontal slots, arranged in two horizontal rows, sized for receiving fasteners having heads; and b. wherein said adjustment panel forms a portion of a back wall of said cabinet and further comprises:

i. a threaded hand screw sleeve: and ii. said threaded hand screw, operable to extend beyond a plane defined by the surface of said adjustment panel, responsive to being manually turned in said hand screw sleeve via said fin;

iii. wherein said hand screw further comprises:

1. a cylindrical web having external threads and closed on a first end;

2. a longitudinal axle extending from said first end within said cylindrical web;

3. said fin supported by said axle and by said cylindrical web having external threads; and 4. a plurality of bracing flanges extending from said axle to said cylindrical web.

2. The cabinet of claim 1, comprising at least two adjustable feet, each manually adjustable through an opening in a bottom panel of said cabinet using a torque-delivering tool.

3. The cabinet of claim 2, wherein each said adjustable foot of said at least two adjustable feet comprises:

a. a shell comprising:

i. a base configured to receive a frictional bottom cap;

ii. a first cylindrical foot web extending upward from said base; and iii. a captive nut proximate a top of said shell;

b. a sleeve comprising:

i. a second cylindrical foot web sized to slidingly receive said first cylindrical web;

ii. a captive washer proximate a top of said second cylindrical foot web sized and positioned to capture a particular bolt head;

iii. a bolt, having said particular bolt head having a torque-receiving socket, extending through said captive washer and threaded into said captive nut;

iv. a fastener plate, comprising a plurality of fastener openings and a central opening alignable to said torque-receiving socket, wherein said fastener plate is attached to a top edge of said second cylindrical foot web.

4. The cabinet of claim 1, comprising a bracket, said bracket further comprising:

a. a back panel of said cabinet back wall, said back panel having a staggered arrangement of at least seven horizontal slots in two horizontal rows;

b. first and second opposed end panels extending at right angles to said back panel, wherein said first and second opposed end panels have first and second threaded rods, respectively, extending from first and second inside surfaces of said first and second end panels, respectively;

c. first and second corner reinforcements between said back panel and said first and second end panels, respectively, wherein said first and second corner reinforcements comprise first and second threaded bores, respectively;

d. first and second adjustment screws operable to be threaded into and through said threaded bores; and e. first and second end fastener plates slidingly receivable into said first and second end panels, respectively, wherein:
   i. said first and second end fastener plates comprise first and second horizontal slots sized to receive said first and second threaded rods, respectively; and
   ii. said first and second end fastener plates comprise first and second vertical slots;
f. a flange:
   i. extending downward from said back panel; and
   ii. extending horizontally outward from said back panel by a length equal to a thickness of a sidewall of said cabinet.

5. The cabinet of claim 1, comprising a removable top panel.

6. The cabinet of claim 5, comprising:
a. said cabinet without said removable top panel;
b. an upper modular cabinet comprising a top panel;
c. an adapter for coupling said upper modular cabinet to said cabinet, wherein:
   i. said adapter is operable to be installed in place of said removable top panel;
and
   ii. said adapter is made from three pieces fastened together with at least one of adhesive and at least one dowel.

7. The cabinet of claim 6, wherein said adapter comprises:
a. a center piece;
b. left and right wings coupled orthogonally to said center piece and parallel to each other to form said adapter with top and bottom surfaces,
c. a plurality of lock pins extending from said top and bottom surfaces; and
d. a plurality of dowels extending from said top and bottom surfaces.

8. The cabinet of claim 6, further comprising:
a. first bi-fold doors on said cabinet;
b. second bi-fold doors on said upper modular cabinet;
c. first left and right handles proximate a top of said first bi-fold doors and proximate a closure seam of said first bi-fold doors;
d. second left and right handles proximate a bottom of said second bi-fold doors and proximate a closure seam of said second bi-fold doors;
e. left and right removable door-handle couplings engaging said first and second left door handles and said first and second right door handles, respectively; and
f. wherein said left and right door-handle couplings are sufficiently rigid to enable said first and second left doors to be operated as one door and to enable said first and second right doors to be operated as one door, respectively.

9. A cabinet securable to a wall, the cabinet comprising:
a. at least one adjustment panel, comprising:
   i. at least one hand screw comprising a fin for manual operation installed through said adjustment panel; and
   ii. at least three horizontal slots, arranged in two horizontal rows, sized for receiving fasteners having heads;
   iii. wherein said adjustment panel forms a portion of a back wall of said cabinet;
b. a bottom panel having a plurality of openings corresponding to a plurality of adjustable feet attached there under, wherein said plurality of openings provide access to adjusting means for said adjustable feet;
c. first and second side panels coupled to said bottom panel; and
d. top couplings on top edges of said first and second side panels and said back wall for coupling one of an upper cabinet and a removable top panel
e. wherein each said adjustable foot of said plurality of adjustable feet comprises:
f. a shell comprising:
   i. a base configured to receive a frictional bottom cap;
   ii. a first cylindrical web extending upward from said base; and
   iii. a captive nut proximate a top of said shell;
g. a sleeve comprising:
   i. a second cylindrical web sized to slidingly receive said first cylindrical web;
   ii. a captive washer proximate a top of said second cylindrical web sized and positioned to capture a particular bolt head;
   iii. a bolt, having said particular bolt head having a torque-receiving socket, said bolt extending through said captive washer and threaded into said captive nut;
   iv. a fastener plate, comprising a plurality of fastener openings and a central opening alignable to said torque-receiving socket, wherein said fastener plate is attached to a top edge of said second cylindrical web.

10. The cabinet of claim 9, comprising:
a. an upper modular cabinet comprising a top panel;
b. an adapter for coupling said upper modular cabinet to said cabinet, wherein:
   i. said adapter is operable to be installed to said top couplings; and
   ii. said adapter is made from three pieces fastened together with at least one of adhesive and at least one dowel.

11. The cabinet of claim 10, wherein said adapter comprises:
a. a center piece;
b. left and right wings coupled orthogonally to said center piece and parallel to each other to form said adapter with top and bottom surfaces,
c. a plurality of lock pins extending from said top and bottom surfaces; and
d. a plurality of dowels extending from said top and bottom surfaces.

12. The cabinet of claim 10, further comprising:
a. first bi-fold doors on said cabinet;
b. second bi-fold doors on said upper modular cabinet;
c. first left and right handles proximate a top of said first bi-fold doors and proximate a closure seam of said first bi-fold doors;
d. second left and right handles proximate a bottom of said second bi-fold doors and proximate a closure seam of said second bi-fold doors; and
e. left and right removable door-handle couplings engaging said first and second left door handles and said first and second right door handles, respectively; and
f. wherein said left and right door-handle couplings are sufficiently rigid to enable said first and second left doors to be operated as one door and to enable said first and second right doors to be operated as one door, respectively.

13. A cabinet securable to a wall, the cabinet comprising:
a. first and second adjustment panels, each comprising:
   i. at least one hand screw comprising a fin for manual operation installed through said adjustment panel; and
   ii. at least three horizontal slots, arranged in two horizontal rows, sized for receiving fasteners having heads;
b. a bottom panel comprising a front and a back;

c. first and second opposing side panels, each having a top and a bottom, coupled to said bottom panel;

d. wherein said first adjustment panel is coupled to and between said first and second opposing side panels proximate said back of said bottom panel; and e. a bracket, coupled to and between said first and second side panels flush with top edges of said first and second side panels, said bracket further comprising:

i. a back panel of said cabinet back wall, said back panel having a staggered arrangement of horizontal slots in two horizontal rows;

ii. first and second opposed end panels extending at right angles to said back panel, wherein said first and second opposed end panels have first and second threaded rods, respectively, extending from first and second inside surfaces of said first and second end panels, respectively;

iii. first and second corner reinforcements between said back panel and said first and second end panels, respectively, wherein said first and second corner reinforcements comprise first and second threaded bores, respectively;

iv. first and second adjustment screws operable to be threaded into and through said threaded bores; and v. first and second end fastener plates slidingly receivable into said first and second end panels, respectively, wherein:

1. said first and second end fastener plates comprise first and second horizontal slots sized to receive said first and second threaded rods, respectively;

2. said first and second end fastener plates each comprise first and second vertical slots; and vi. a flange:

1. extending downward from said back panel; and 2. extending horizontally outward from said back panel by a length equal to a thickness of said side panel of said cabinet.

14. The cabinet of claim 13, wherein:

a. said second adjustment panel is coupled to and between said first and second opposing side panels flush with said tops of said side panels;

b. an upper modular cabinet comprising:

i. a top panel;

ii. third and fourth adjustment panels, each comprising:

1. at least one hand screw installed through said adjustment panel; and 2. at least three horizontal slots, arranged in two horizontal rows, sized for receiving fasteners having heads;

c. an adapter for coupling said upper modular cabinet to said cabinet, wherein said adapter is operable to be installed on top edges of said first and second opposing side panels and on a top edge of said second adjustment panel, wherein said adapter comprises:

i. a center piece;

ii. left and right wings coupled orthogonally to said center piece and parallel to each other to form said adapter with top and bottom surfaces, iii. a plurality of lock pins extending from said top and bottom surfaces; and iv. a plurality of dowels extending from said top and bottom surfaces;

d. first bi-fold doors on said cabinet;

e. second bi-fold doors on said upper modular cabinet;

f. first left and right handles proximate a top of said first bi-fold doors and proximate a closure seam of said first bi-fold doors;

g. second left and right handles proximate a bottom of said second bi-fold doors and proximate a closure seam of said second bi-fold doors;

h. left and right removable door-handle couplings engaging said first and second left door handles and said first and second right door handles, respectively; and i. wherein said left and right door-handle couplings are sufficiently rigid to enable said first and second left doors to be operated as one door and to enable said first and second right doors to be operated as one door, respectively;

j. a plurality of openings in said bottom panel corresponding to a plurality of adjustable feet attached there under, wherein said plurality of openings provide access to adjusting means for said plurality of adjustable feet;

k. wherein each said adjustable foot of said plurality of adjustable feet comprises:

i. a shell comprising:

1. a base configured to receive a frictional bottom cap;

2. a first cylindrical web extending upward from said base; and 3. a captive nut proximate a top of said shell;

ii. a sleeve comprising:

1. a second cylindrical web sized to slidingly receive said first cylindrical web;

2. a captive washer proximate a top of said second cylindrical web sized and positioned to capture a particular bolt head;

3. a bolt, having said particular bolt head having a torque-receiving socket, extending through said captive washer and threaded into said captive nut;

iii. a fastener plate, comprising a plurality of fastener openings and a central opening alignable to said torque-receiving socket, wherein said fastener plate is attached to a top edge of said second cylindrical web.

15. The cabinet of claim 14, further comprising at least one adjustment panel coupled to and between said first and second side panels, wherein said attachment panel comprises at least three horizontal slots in a staggered arrangement in at least two horizontal rows.

16. The cabinet of claim 13, further comprising a removable top panel.

* * * * *